US006179549B1

(12) United States Patent
Hayakawa

(10) Patent No.: US 6,179,549 B1
(45) Date of Patent: Jan. 30, 2001

(54) LOADING AND UNLOADING DEVICE FOR SHEET METALS

(75) Inventor: Minoru Hayakawa, Irvine, CA (US)

(73) Assignee: Amada Metrecs Company, Ltd., Kanagawa (JP)

( * ) Notice: Under 35 U.S.C. 154(b), the term of this patent shall be extended for 0 days.

(21) Appl. No.: 08/976,117

(22) Filed: Nov. 21, 1997

(51) Int. Cl.[7] ..... B65G 1/04

(52) U.S. Cl. ..... 414/796.7; 414/222.11; 414/797

(58) Field of Search ..... 414/797, 796.7, 414/222.07, 222.11, 222.12, 222.13, 222.01; 198/719; 15/77, 88.1

(56) References Cited

U.S. PATENT DOCUMENTS

| | | | | |
|---|---|---|---|---|
| 3,912,253 | * | 10/1975 | Jarman | 414/797 |
| 4,177,101 | * | 12/1979 | Evans | 156/300 |
| 4,311,304 | * | 1/1982 | Hamada et al. | 414/797 |
| 4,465,426 | * | 8/1984 | Jonsson | 414/222 |
| 4,648,786 | * | 3/1987 | Sakurai | 414/222 |
| 4,768,913 | * | 9/1988 | Baba | 414/797 |
| 5,358,375 | * | 10/1994 | Kawada et al. | 414/222 |
| 5,392,630 | * | 2/1995 | Marinoni et al. | 414/797 |
| 5,651,160 | * | 7/1997 | Yonemizu et al. | 15/302 |
| 5,700,128 | * | 12/1997 | Tonnigs et al. | 414/797 |
| 5,728,229 | * | 3/1998 | Depres | 134/32 |
| 5,765,984 | * | 6/1998 | Stefano | 414/797 |
| 5,803,447 | * | 9/1998 | Singer et al. | 414/797 |

FOREIGN PATENT DOCUMENTS 0 780 172 A2 6/1997 (EP) .

* cited by examiner

*Primary Examiner*—Douglas Hess
(74) *Attorney, Agent, or Firm*—Blank Rome Comisky & McCauley LLP

(57) ABSTRACT

A loading and unloading device for sheet metals for loading and unloading sheet metals to and from a sheet metal working machine, comprises: a chucking unit lifting a sheet metal by chucking the sheet metal; a loading and unloading clamping unit disposed adjacent to the chucking unit, the loading and unloading clamping unit moving in a direction of approaching to and leaving from the sheet metal working machine; and a sheet metal carrying unit carrying the sheet metal lifted by the chucking unit to the position of the loading and unloading clamping unit.

5 Claims, 12 Drawing Sheets

LOADING AND UNLOADING DEVICE FOR SHEET METALS

BACKGROUND OF THE INVENTION

1. Field of the Invention

The present invention relates to a loading and unloading device for sheet metals and relates, more particularly, to a loading and unloading device for sheet metals for automatically loading and unloading sheet metals to and from a sheet metal working machine.

2. Description of the Related Art

As a related art, there exists a sheet metals loading and unloading device for loading sheet metals to be worked to and unloading worked sheet metals from a turret punch press respectively, for example, as a sheet metal working machine.

This loading and unloading device for sheet metals includes a vacuum chucking unit for lifting a sheet metal by vacuum-chucking the sheet metal corresponding to a position of a movable table of a turret punch press, a loading unit for moving the vacuum chucking unit which has vacuum-chucked the sheet metal to the turret punch press, and an unloader for carrying worked sheet metal from the turret punch press.

At a lower side of the vacuum chucking unit, a pallet for a sheet metal to be worked loaded with a sheet metal to be worked is set, and a pallet for a worked sheet metal for loading a worked sheet metal is mounted on a lifter at a lower side of this vacuum chucking unit.

A supporting table is provided at a height position almost at the same height position as the movable table which is at a lower position of the vacuum chucking unit. This supporting table is capable of freely moving in both lateral directions from a lateral position of the movable table. Particularly, the supporting table can move in a direction orthogonal with a direction of loading and unloading a sheet metal to be worked to and from the turret punch press.

Based on the above-described structure, the vacuum chucking unit lifts a sheet metal loaded on the pallet for a sheet metal to be worked, in the state that the supporting table is moved back to a neutral position for loading and unloading a sheet metal to be worked from the turret punch press. The supporting table is returned to the neutral position to support the vacuum-chucked sheet metal, and the vacuum-chucked sheet metal is carried to the turret punch press by the loading unit.

Further, a worked sheet metal W is carried to the unloader and then the worked sheet metal W is unclamped and loaded on the supporting table. The supporting table is moved back again to move the worked sheet metal. The worked sheet metal is clamped by supporting clampers, the supporting table is advanced, and then the worked sheet metals are separated into individual worked sheet metals by a separation hammer. The separated individual worked sheet metals are dropped and loaded on the pallet for worked sheet metals.

According to the above-described relevant art, however, there is a problem that the loading unit itself has an increased weight which results in a high cost. Further, since the positions for carrying out the vacuum chucking of a sheet metal and the position for loading the sheet metal are the same, there is a problem that the sheet metal working machine has to stop its operation during a period while a next sheet metal is being vacuum-chucked after one sheet metal has been loaded to the sheet metal working machine, in order to avoid an interruption of the sheet metal being worked with the vacuum chucking unit.

Further, when the sheet metal working machine is to be used as a single unit, there is a problem that either the loading unit for sheet metals must be moved or the work must be done from an unnatural position.

SUMMARY OF THE INVENTION

The present invention has been achieved with such points in mind.

It therefore is an object of the present invention to provide a loading and unloading device for sheet metals which can carry out loading and unloading sheet metals with a simple and low-cost device and which can prepare loading sheet metals without interrupting the working.

To achieve the object, according to a first aspect of the present invention, there is provided a loading and unloading device for sheet metals to and from a sheet metal working machine, comprising: a chucking unit lifting a sheet metal by chucking the sheet metal; a loading and unloading clamping unit disposed adjacent to the chucking unit, the loading and unloading clamping unit moving in a direction of approaching to and leaving from the sheet metal working machine; and a sheet metal carrying unit carrying the sheet metal lifted by the chucking unit to the position of the loading and unloading clamping unit.

Accordingly, a first one top sheet metal out of loaded sheet metals is lifted by chucking this sheet metal by the chucking unit as a vacuum chucking unit, and this vacuum-chucked sheet metal to be worked is carried to the loading and unloading clamping unit provided adjacent to the vacuum chucking unit by the sheet metal carrying unit. This loading and unloading clamping unit loads and unloads sheet metals carried by the sheet metal carrying unit to and from the sheet metal working machine. Since the vacuum-chucked sheet metal to be worked is carried to the loading and unloading clamping unit provided adjacent to the vacuum chucking unit by the sheet metal carrying unit, the position for vacuum-chucking one sheet metal and the position for loading and unloading the sheet metal to and from the sheet metal working machine are different. Accordingly, it is possible to carry out vacuum chucking of one sheet metal without interrupting the working of a sheet metal during the working, so that the working efficiency can be improved. Further, since the device can be simplified, the cost of the device can be lowered.

According to a second aspect of the present invention, as it depends from the first aspect, the sheet metal carrying unit comprises a supporting table moving between a position corresponding to the chucking unit and a position corresponding to the loading and unloading clamping unit.

Accordingly, the sheet metal carrying unit can freely make a reciprocating move for supplying to the loading and unloading clamping unit the sheet metals loaded to the vacuum chucking unit by the supporting table. Therefore, it is not necessary to provide a moving mechanism in the vacuum chucking unit. As a result, the overall structure of the device becomes simple, which enables a cost reduction of the device.

According to a third aspect of the present invention, as it depends from the second aspect, the supporting table has a brush table; and the loading and unloading clamping unit has a lower jaw moving upwards and downwards.

Accordingly, the brush table supports sheet metals when the sheet metals are carried by being loaded on the brush table or when the sheet metals are loaded and unloaded to and from the sheet metal working machine by the loading and unloading clamping unit. Further, in the loading and unloading clamping unit, a sheet metal is set between an upper jaw and a lower jaw and the lower jaw is moved upwards to clamp the sheet metal in co-operation with the upper jaw. Therefore, the sheet metal can be supported without being hurt and the sheet metal can be moved on the upper surface of the brush table. Further, according to the loading and unloading clamping unit, since the sheet metal is set between the upper jaw and the lower jaw and the lower jaw is moved upwards to clamp the sheet metal in co-operation with the upper jaw, it becomes unnecessary to lift the clampers after clamping the sheet metal unlike the prior-art technique. As a result, the loading and unloading of sheet metals by the loading and unloading clamping unit becomes simple for an improved working efficiency.

BRIEF DESCRIPTION OF THE ACCOMPANYING DRAWINGS

The above and further objects and novel features of the present invention will more fully appear from the following detailed description when the same is read in conjunction with the accompanying drawings, in which:

FIGS. 12A and 12B show the loading operation according to the loading and unloading device of the present invention;

DETAILED DESCRIPTION OF THE PREFERRED EMBODIMENTS

Figure 1:
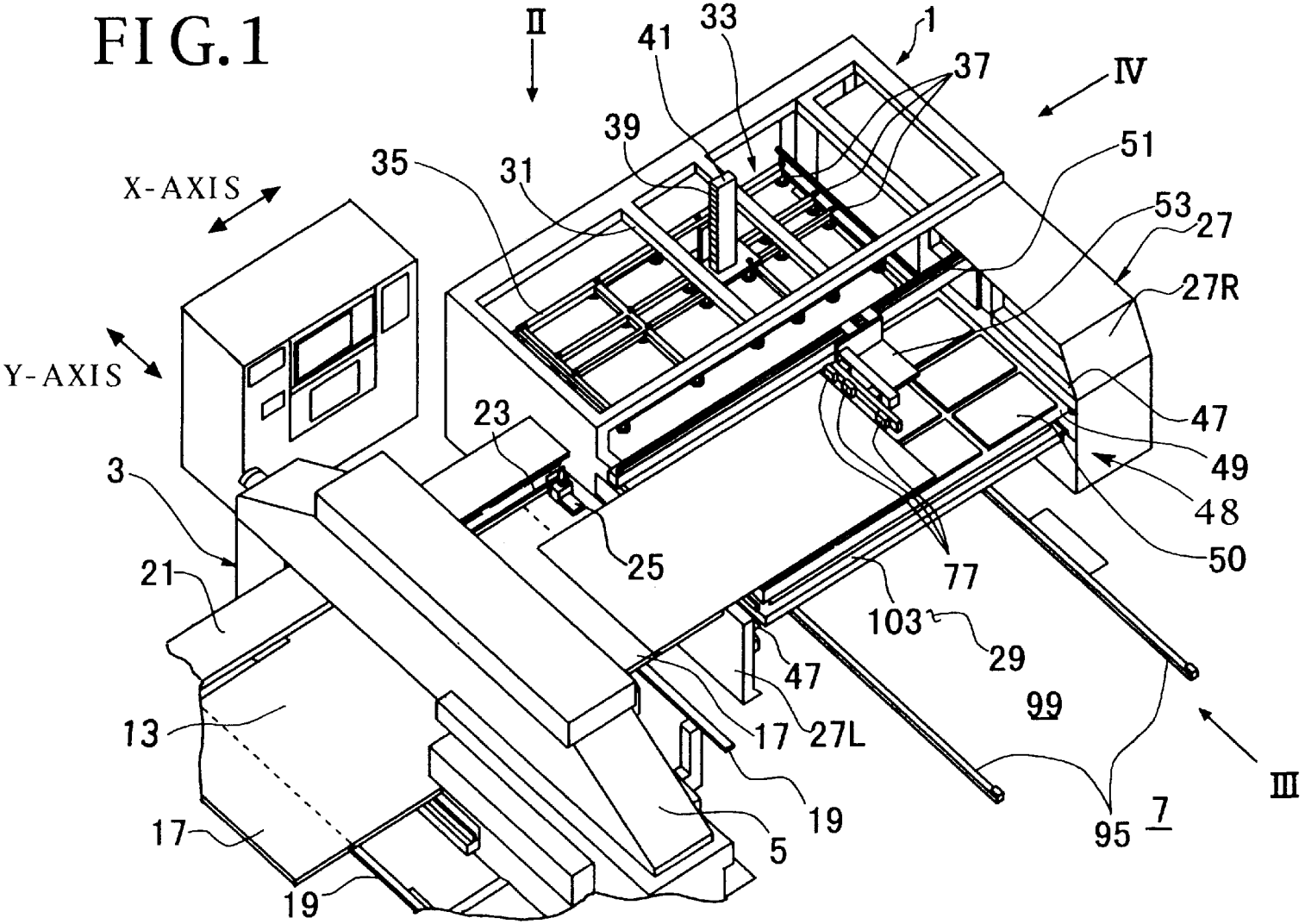
FIG. 1 is a perspective view for showing the whole of a loading and unloading device for sheet metals relating to the present invention.

There will be detailed below the preferred embodiments of the present invention with reference to the accompanying drawings. Like members are designated by like reference characters.

FIGS. 1 to 4 show a whole structure of a loading and unloading device 1 for sheet metals relating to the present invention.

In a turret punch press 3, a frame 5 having a gap not shown in the center is provided in a base 7. At an upper side of this gap, an upper turret 9 loaded with a plurality of punches P is provided to be able to be exposed by rotation, and at a lower side of the gap, a lower turret 11 loaded with a plurality of dies D is provided to be able to be exposed by rotation facing the upper turret 9.

A fixed table 13 is provided at a lower side of the gap, and a number of free bearings 15 are provided on the upper plane of the fixed table 13. On both left and right sides (both left and right sides in FIG. 2) of the fixed table 13, movable tables 17 are provided to be able to move and be positioned in a Y axis direction along a pair of guide rails 19 extended in the Y axis direction. A carriage base 21 for connecting the left and right side movable tables 17 is provided to be able to move and be positioned in a Y axis direction, and, in this carriage base 21, an X axis carriage 23 is provided to be able to move and be positioned in an X axis direction. The X axis carriage 23 is provided with a pair of work clampers 25 so as to be able to adjust distance therebetween.

Based on the above-described structure, a work W loaded and positioned at an original point is clamped by the work clampers 25, the X axis carriage 23 is moved and positioned in the X axis direction and the carriage base 21 is moved and positioned in the Y axis direction so that a desired position of the work W is matched with a working position of the turret punch press 3 and the punches P are blown by a blower not shown to carry out punching by the co-operation between the punches P and the dies D.

Figure 2:
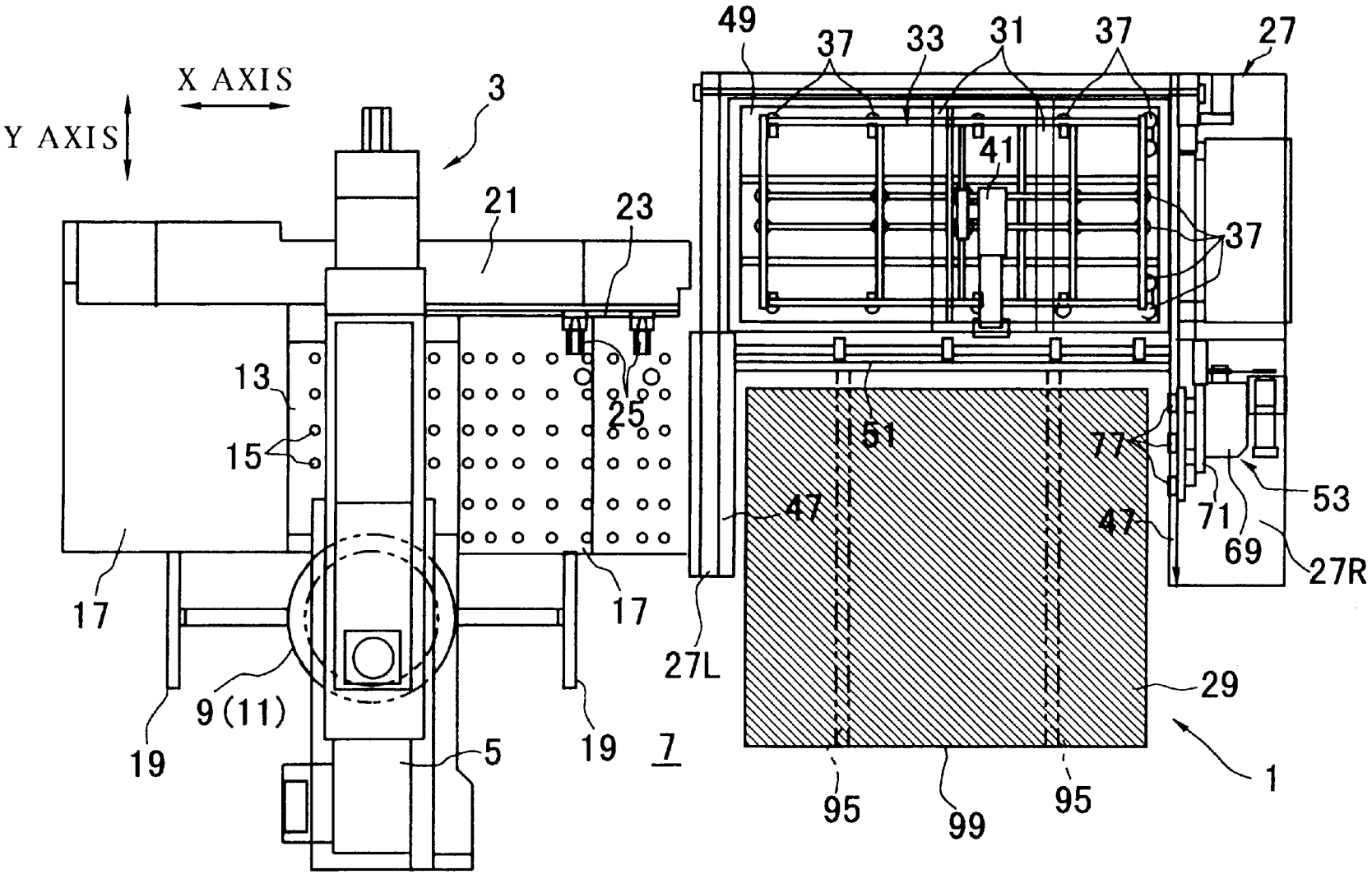
FIG. 2 is a top plan view viewed from a direction of II in FIG. 1.

Referring to FIG. 2, a loading and unloading unit 1 for sheet metals is provided at the right hand side of the turret punch press 3. In this loading and unloading unit 1 for sheet metals, a loading and unloading frame 27 with a height extending above the upper plane of the movable tables 17 is provided in the range from the front end of the movable tables 17 (the lower end in FIG. 2) when the carriage base 21 is positioned at the original point to the front exceeding the position of the carriage base 21 (upper side in FIG. 2).

The loading and unloading frame 27 has a U-shape viewed from the top, and has a space 29 within a range adjacent to the movable table 17. A supporting groove 31 is built in the center portion of the upper plane at an upper side of the space 29 in FIG. 2. A machine accommodation section is provided in a right hand frame 27R of the loading and unloading frame 27.

A sheet taking-up unit 33 as a chucking unit capable of lifting each one work W of sheet metals to be worked is provided at a portion of a lateral side or upper side of the carriage base 21 of the loading and unloading frame 27 in FIG. 2. The one sheet taking-up unit 33 is hung with a plurality of vacuum pads 37 so-called vacuum chucks at a lattice point of a sheet taking-up frame 35 built in a lattice shape. At the center of the one sheet taking-up frame 35, a post 41 mounted with a rack 39 is provided in a vertically upward direction. A driving monitor 45 mounted with a pinion 43 engaged with this rack 39 is provided at an upper side of the supporting groove 31. Accordingly, the post 41 mounted with the rack 39 is moved up and down by rotating the pinion 43 by a driving motor 45, to thereby move the one sheet taking-up frame 35 up and down.

Figure 6:
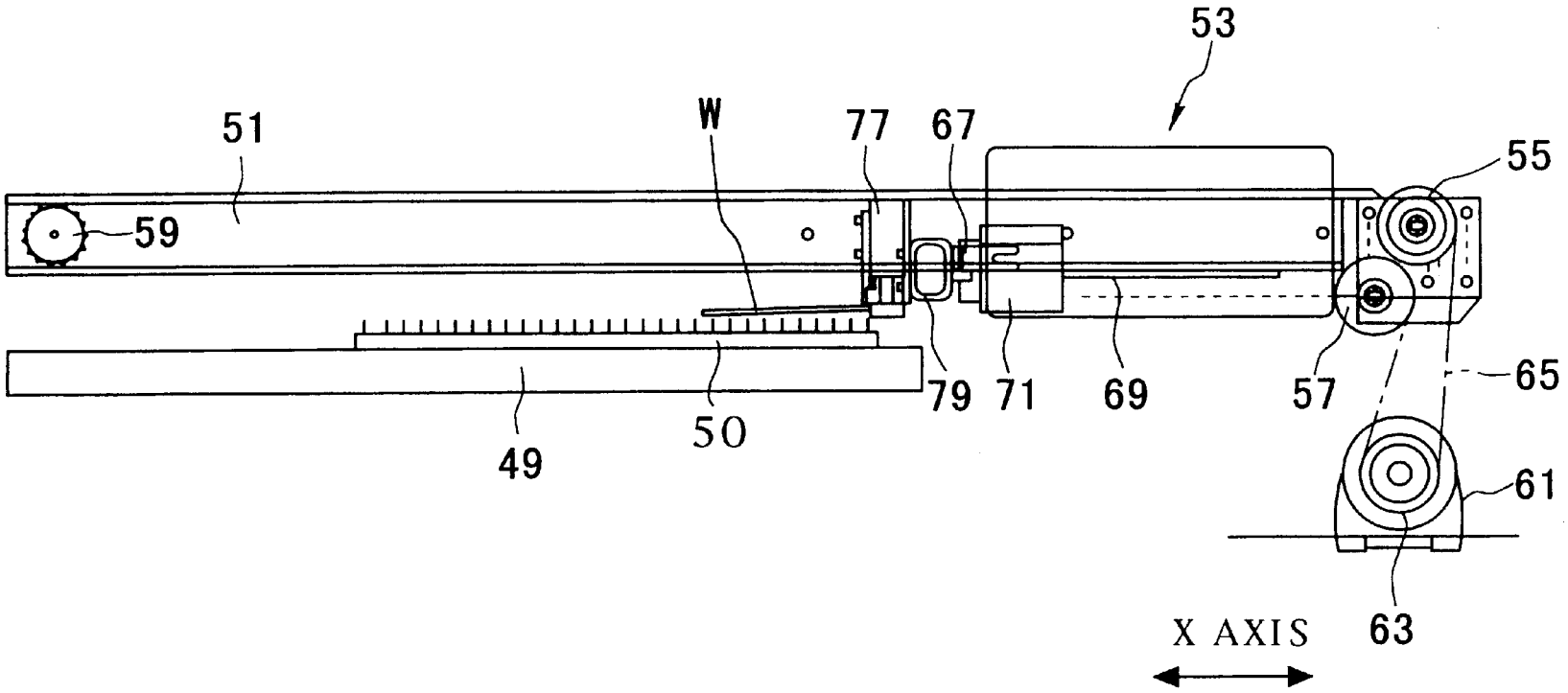
FIG. 6 is a front view viewed from a direction of VI in FIG. 5.

A guide rails 47 for table is provided along the whole length in a Y axis direction at one stage below the one sheet taking-up unit 33 in the left and right frames 27L and 27R respectively of the loading and unloading frame 27. The guide rails 47 slidably guide a supporting table 49 in the Y axis direction. The supporting table 49 and the guide rails 47 constitute a sheet metal carrying unit which is movably loading sheet metals to be worked W to be loaded and worked sheet metals W to be unloaded. Further, an endless chain to be run in rotation by a motor not shown, for example, is provided along the guide rails 47 for moving the supporting table 49 in the Y axis direction. A brush table 50 is installed on the supporting table 49 as shown in FIG. 6. The upper plane of the brush table 50 has a height almost the same as the height of the upper plane of the movable table 17. Accordingly, when the motor runs the chain in rotation, the brush table 50 can make a reciprocating move in a Y axis direction from a lateral side position of the movable tables 17 to a lower position of the one sheet taking-up unit 33.

Figure 5:
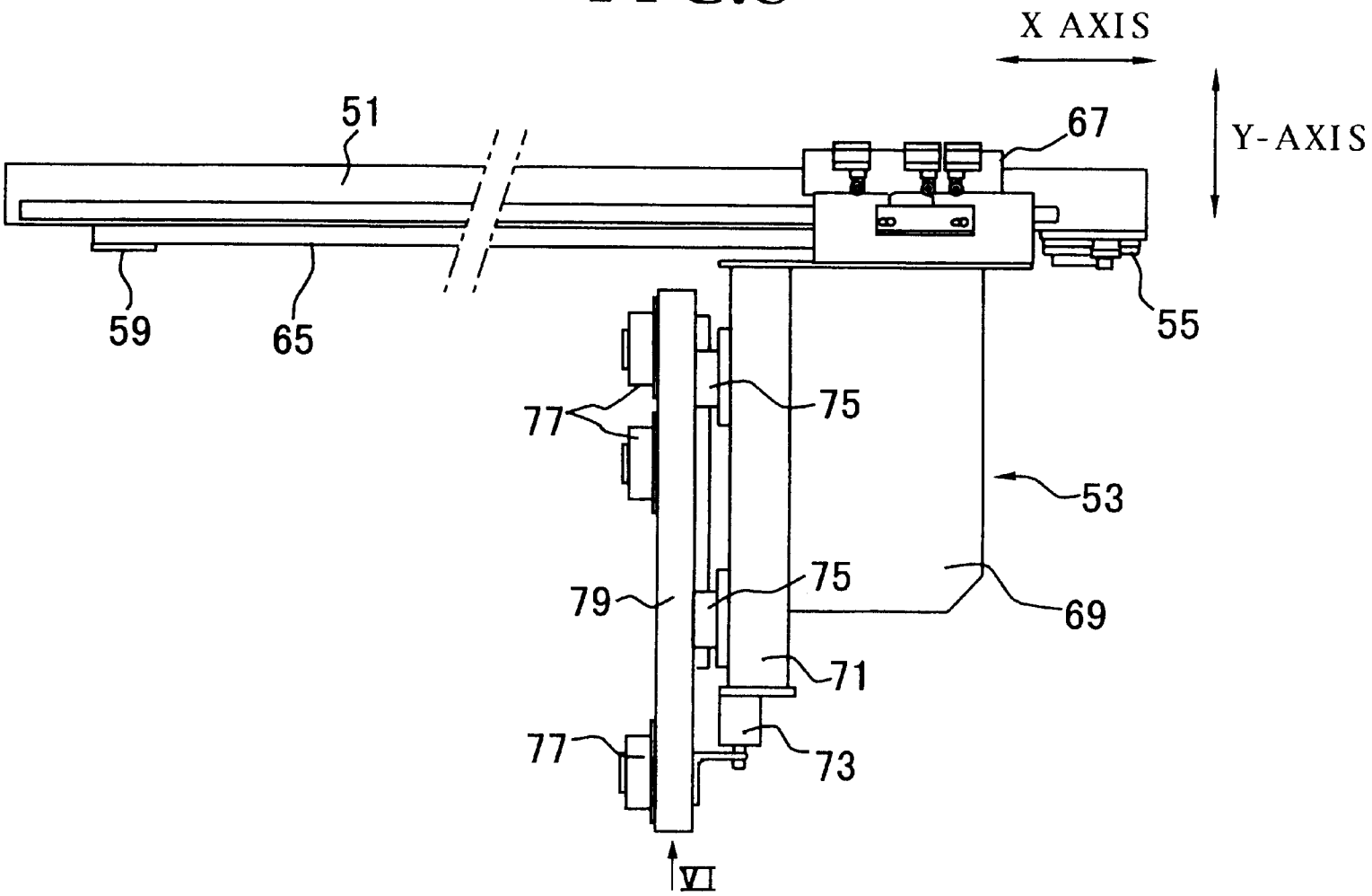
FIG. 5 is a top plan view of a loader and unloader.

Referring to FIGS. 5 and 6, a loader and unloader guide rail 51 is provided across the loading and unloading frame 27 in an X axis direction at a position corresponding to the original point position of the turret punch press 3 of the loading and unloading frame 27. This loader and unloader guide rail 51 is provided movably in an X axis direction with a loader and unloader 53 as a loading and unloading clamping unit for loading and unloading sheet metals to be worked or worked sheet metals W.

A pair of idle sprockets 55 and 57 are provided at the right end portion of the loader and unloader guide rail 51, and an idle sprocket 59 is rotatably provided at the left end portion of the loader and unloader guide rail 51, in FIG. 6. In FIG. 6, a driving motor 61 is provided at a lower side of the idle sprockets 55 and 57, and a driving sprocket 63 is mounted on the rotational driving axis.

The driving sprocket 63 and the idle sprockets 55, 57 and 59 are wound with an endless chain 65, and the loader and unloader 53 is installed at a predetermined position of this chain 65. Accordingly, when the driving motor 61 runs the chain 65 in rotation, the loader and unloader 53 can make a reciprocating move in an X axis direction.

The loader and unloader 53 is provided with a slider 67 movably supported in an X axis direction along the loader and unloader guide rail 51. A supporting member 71 reinforced by a bracket 69 is provided in the slider 67, and a cylinder 73 is provided at the front end of the supporting member 71 (the lower end in FIG. 5). Further, a pair of guide receivers 75 are provided in the supporting member 71. A clamper base 79 mounted with work clampers 77 as a plurality (three in this case) of loading and unloading clamping units is movably supported in an X axis direction by the guide receivers 75.

Figure 7:
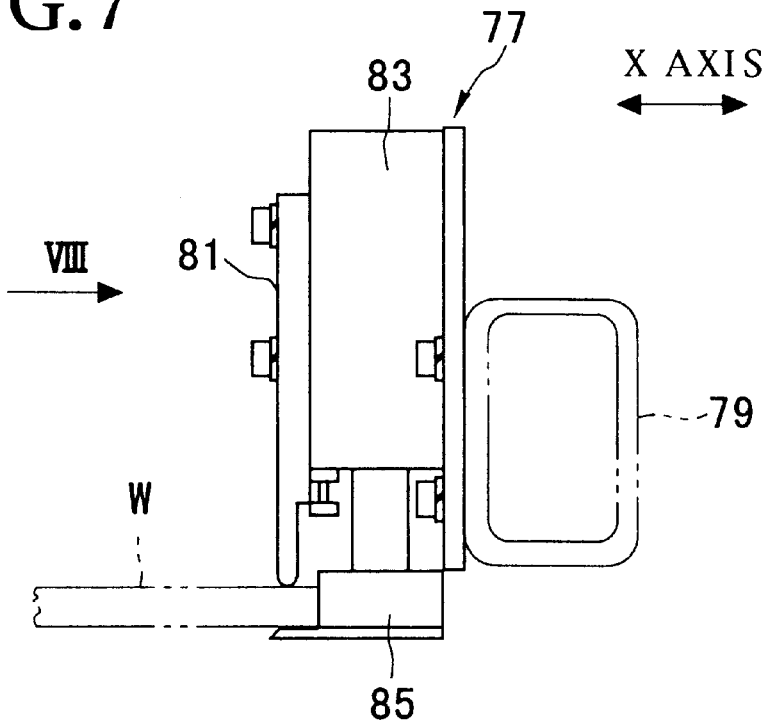
FIG. 7 is an enlarged side view of a work clamper.
Figure 8:
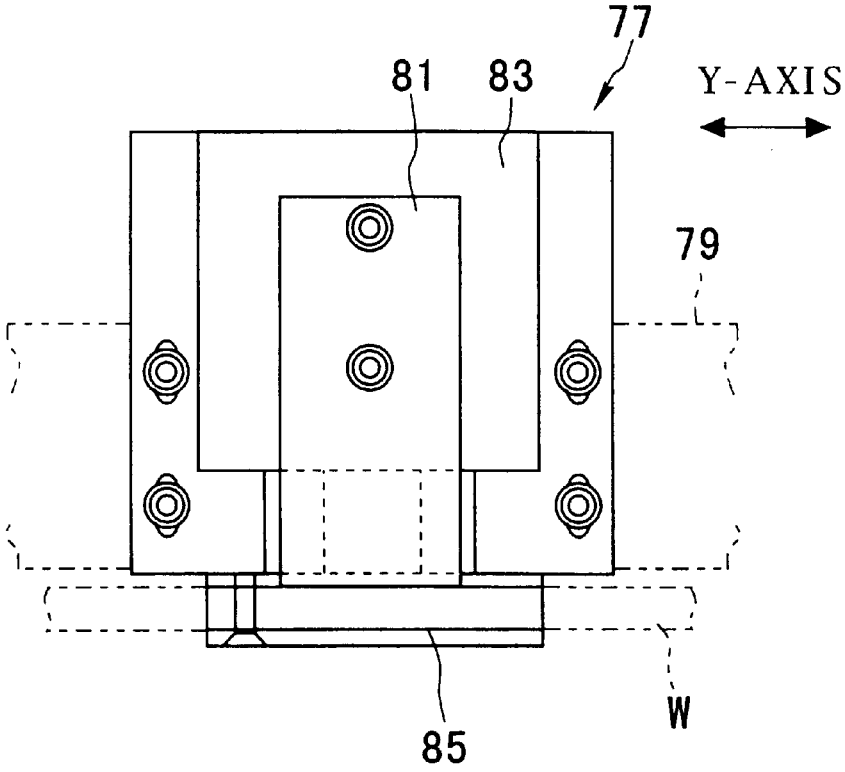
FIG. 8 is an enlarged front view viewed from a direction of VIII in FIG. 7.

Referring to FIGS. 7 and 8, in each of the work clampers 77, an upper jaw 81 is fixed to the clamper base 79, and a lower jaw 85 is provided in a clamper cylinder 83 provided integrally with the upper jaw 81.

With the above-described structure, since the lower jaw 85 is raised by the clamper cylinder 83 to clamp the work W in co-operation with the upper jaw 81, it is not necessary to raise the whole of the work clamper 77 to move after having clamped the work W by lowering the upper jaw 81, unlike the prior-art clamper. Thus, the working efficiency can be improved.

Accordingly, after the work W is clamped as described above, the clamper base 79 is moved in a Y axis direction by the cylinder 73 provided at the front end of the supporting member 71, the chain 65 is run in rotation by the driving motor 61, and the loader and unloader 53 is moved in an X axis direction along the loader and unloader guide rail 51, so that the work W is moved on the brush table 50 and loaded to the movable table 17. Further, the work W as a worked sheet metal is unloaded from the movable table 17 in the opposite process.

Figure 3:
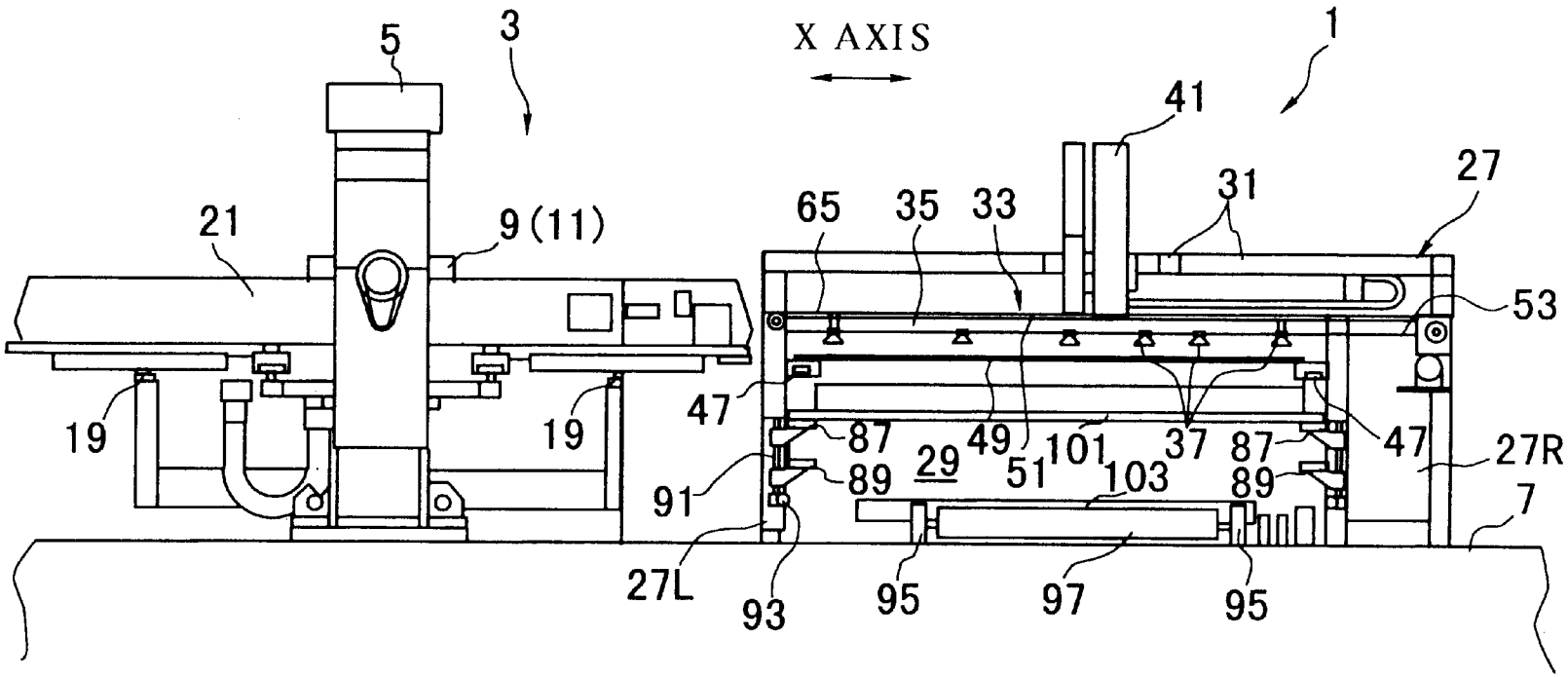
FIG. 3 is a front view viewed from a direction of III in FIG. 1.
Figure 4:
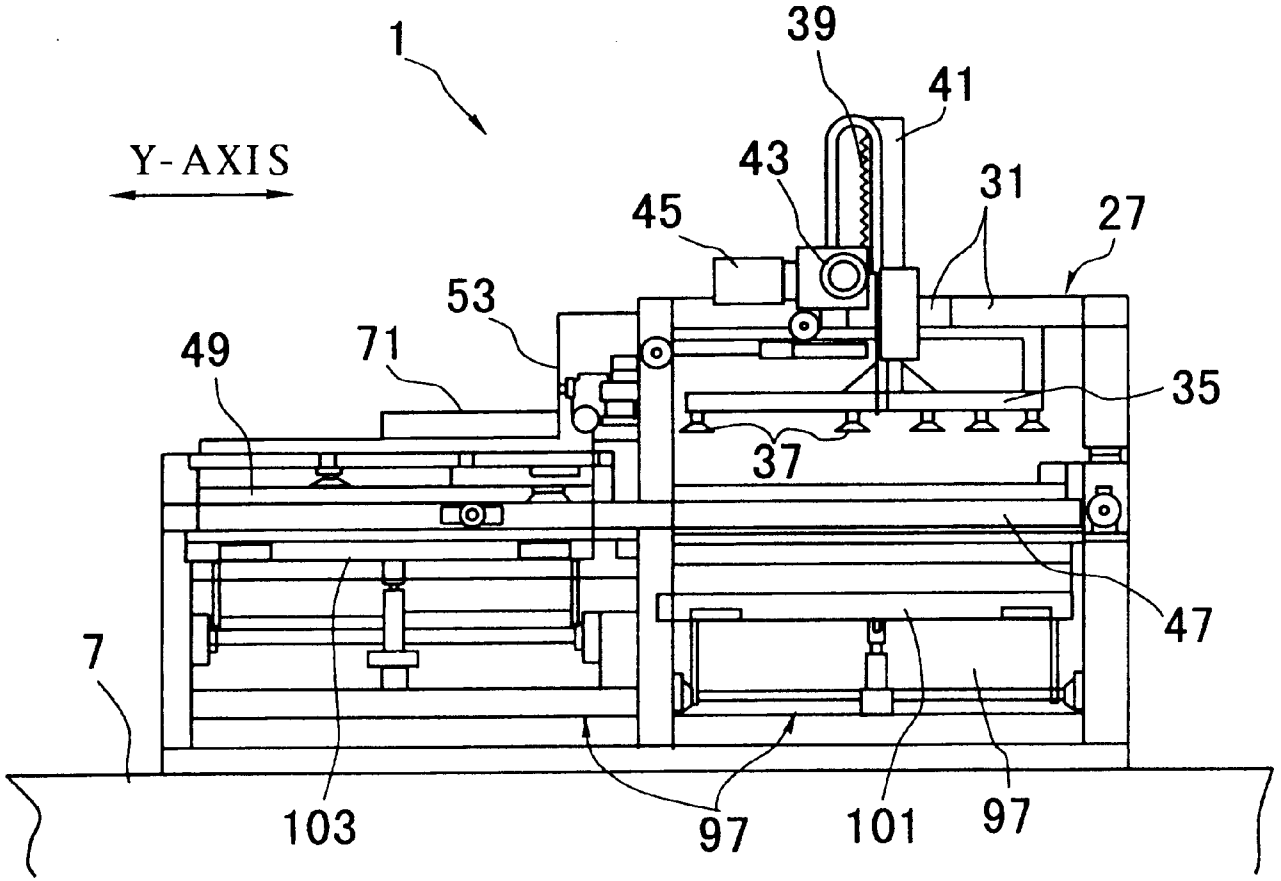
FIG. 4 is a side view viewed from a direction of IV in FIG. 1.

In the mean time, a pair of pallet supporting brackets 87 and 89 for sheet metals to be worked are provided for each stage by two stages of the left and right frames 27L and 27R at a lower position of the guide rail 47 for table inside the left and right frames 27L and 27R, and these sheet metal pallet supporting brackets are selected according to the height of the sheet metals W loaded. These pallet supporting brackets 87 and 89 for sheet metals to be worked are fixed to a rotary axis 91 rotationally provided, for example, and can appear and disappear to the inside from each of the left and right frames 27L and 27R by rotating the rotary axis 91 by a driving unit 93 structured by a motor and a gear mechanism, for example. FIG. 3 shows a state that the pallet supporting brackets 87 and 89 for sheet metals to be worked appear.

Further, a pair of guide rails 95 are extended in a Y axis direction on the base 7 which is in contact with the lower side of the loading and unloading frame 27, and is stretched to the lower side in excess of the loading and unloading frame 27 in FIG. 2. The guide rail 95 is movably provided with a lifter 97 which is moved up and down directions. Accordingly, the lifter 97 can move from the front side of the loading and unloading unit 1 for sheet metals to be worked (the lower side in FIG. 2) to a lower side position of the sheet taking-up unit 33.

Next, the loading and unloading operation of sheet metals by the loading and unloading unit 1 for sheet metals relating to the present invention will be explained below with reference to FIGS. 1 to 4 and FIGS. 9 to 15.

At first, prior to the loading and unloading and working of a sheet metal W, the brush table 50 is moved back (moved upwards in FIG. 2) to make empty a working space 99 at a front side (a lower side in FIG. 2) of the loading and unloading unit 1 for sheet metals. In this working space 99, a pallet 101 for a sheet metal to be worked loaded with the sheet metal W is mounted on the lifter 97. This lifter 97 is moved to a lower side of the sheet taking-up unit 33 along the guide rail 95, and the pallet 101 for sheet metal to be worked is lifted by the lifter 97 in the state that the pallet supporting bracket 87 for sheet metal to be worked is stored. The pallet 101 is lifted to a position higher than the pallet supporting bracket 87 or 89 for sheet metal to be worked, and the lifter 97 is lowered after the pallet supporting bracket 87 or 89 for sheet metal to be worked is taken out. Then, the pallet 101 for sheet metal to be worked is set on the pallet supporting bracket 87 or 89 for sheet metal to be worked. Further, the lifter 97 is advanced to the front side (to a lower side in FIG. 2) and the pallet 103 for worked sheet metal is mounted on the lifter 97 in the working space 99. The pallet 103 for worked sheet metal may be set during the working of the sheet metal W.

Next, the work sheet W is loaded in the following procedure. The brush table 50 is advanced (moved to a lower side in FIG. 2, or to the front side in a perpendicular direction in FIG. 9) to make room at the lower side of the one sheet taking-up unit 33, and a sheet metal to be worked on top of the pallet 101 for sheet metal to be worked is taken up by the vacuum pad 37 by lowering the one sheet taking-up frame 35 by the driving motor 45 (reference FIG. 10). The one sheet taking-up frame 35 is lifted by the driving motor 45 to move back the brush table 50 to below the hung sheet metal W (moved upwards in FIG. 2, reference FIG. 11), and the sheet metal W is released from the vacuum pad 37 and is loaded on the brush table 50.

Figure 15:
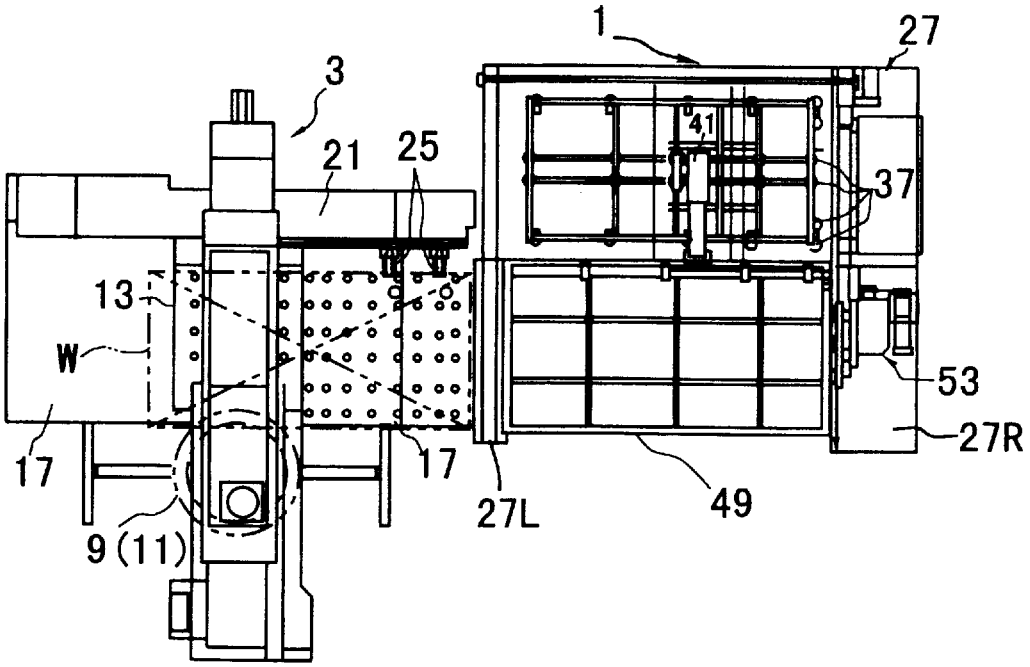
FIG. 15 is a plan view for showing one process of the loading operation according to the loading and unloading device of the present invention.

The brush table 50 loaded with the sheet metal W to be worked is advanced (moved to the front side in a perpendicular direction in FIG. 13, reference FIG. 13), the sheet metal W is clamped by the work clampers 77 of the loader and unloader 53 (reference FIG. 14), and the sheet metal W is loaded to the turret punch press 3 by moving the loader and unloader 53 to the left side in FIG. 2 (reference FIG. 15). The work clamper 77 is unclamped, and the loader and unloader 53 is moved to the right side in FIG. 2 after the sheet metal W is released on the movable table 17, and is stored in the right frame 27R.

Next, the unloading operation of a worked sheet metal W after completing a punching operation will be explained. The loader and unloader 53 is moved to the left in FIG. 15 and the sheet metal W is clamped by the work clampers 77 (reference FIG. 15). The loader and unloader 53 is moved to the right in FIG. 14 and the worked sheet metal W is taken out to the brush table 50 (reference FIG. 14). The brush table 50 is moved back (moved upwards in FIG. 14) in a state of being clamped by the loader and unloader 53 and the sheet metal W is dropped on the pallet 103 for worked sheet metal. In this case, since the pallet 103 for worked sheet metal is lifted to immediately below the brush table 50 by the lifter 97, the sheet metal does not drop suddenly even when the brush table 50 has moved back.

Figure 9:
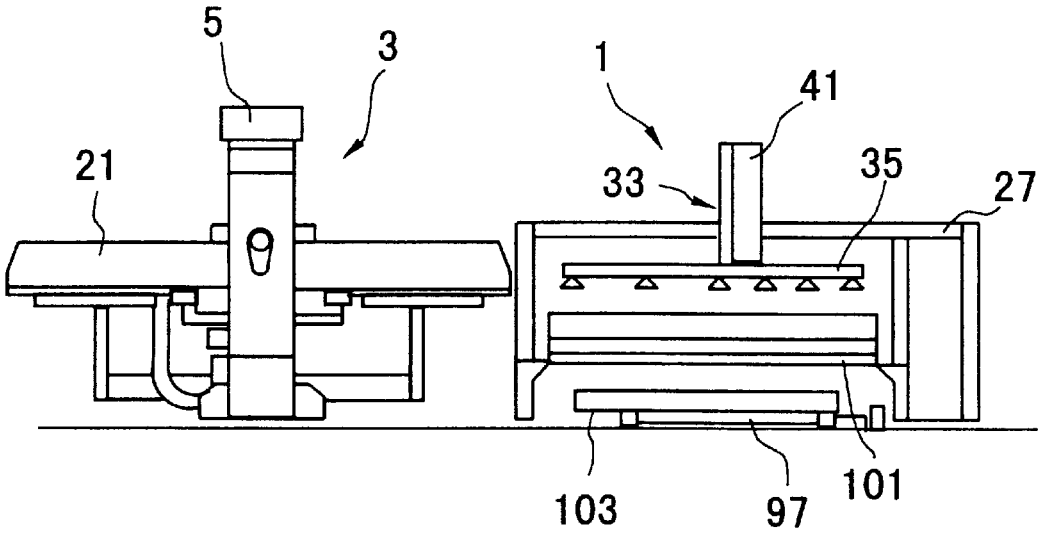
FIG. 9 is a front view for showing one process of the loading operation according to the loading and unloading device of the present invention.
Figure 10:
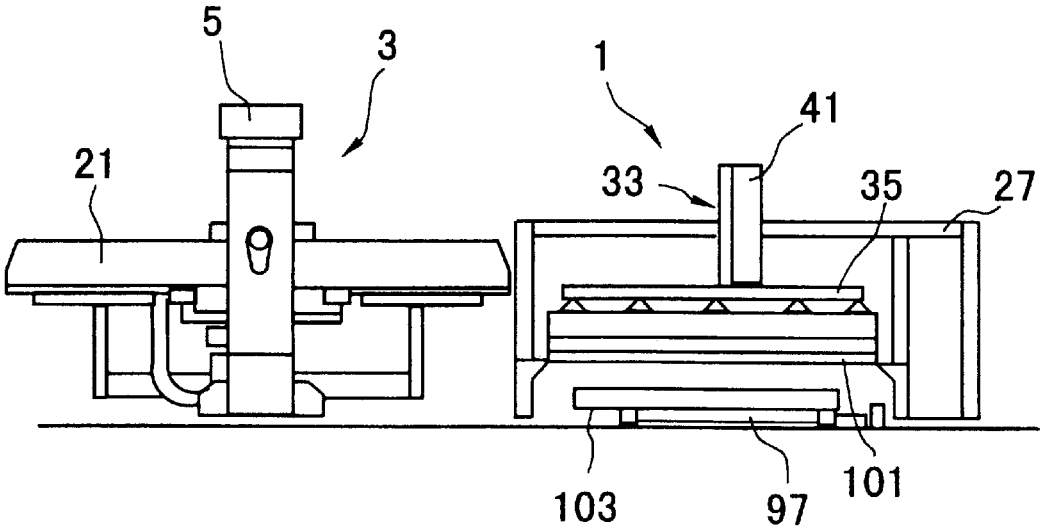
FIG. 10 is a front view for showing one process of the loading operation according to the loading and unloading device of the present invention.
Figure 11:
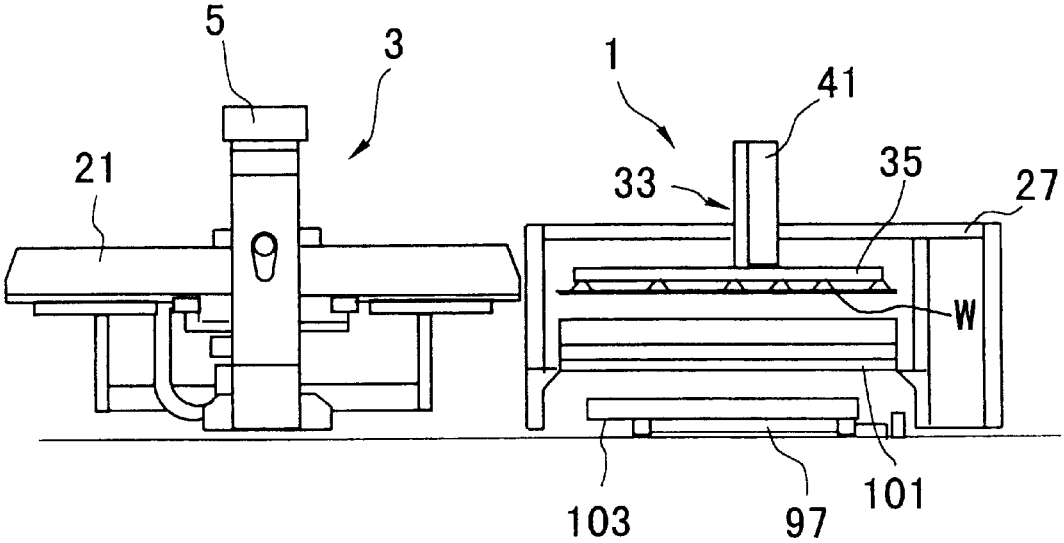
FIG. 11 is a front view for showing one process of the loading operation according to the loading and unloading device of the present invention.
Figure 12A:
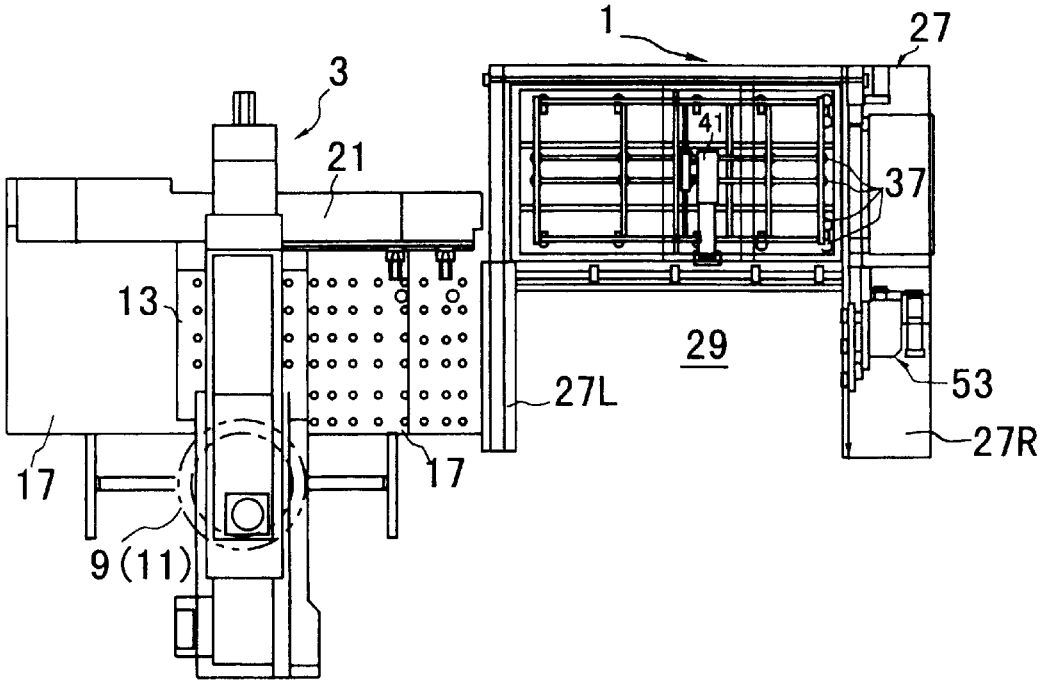
FIG. 12A is a plan view and FIG. 12B is a front view.
Figure 12B:
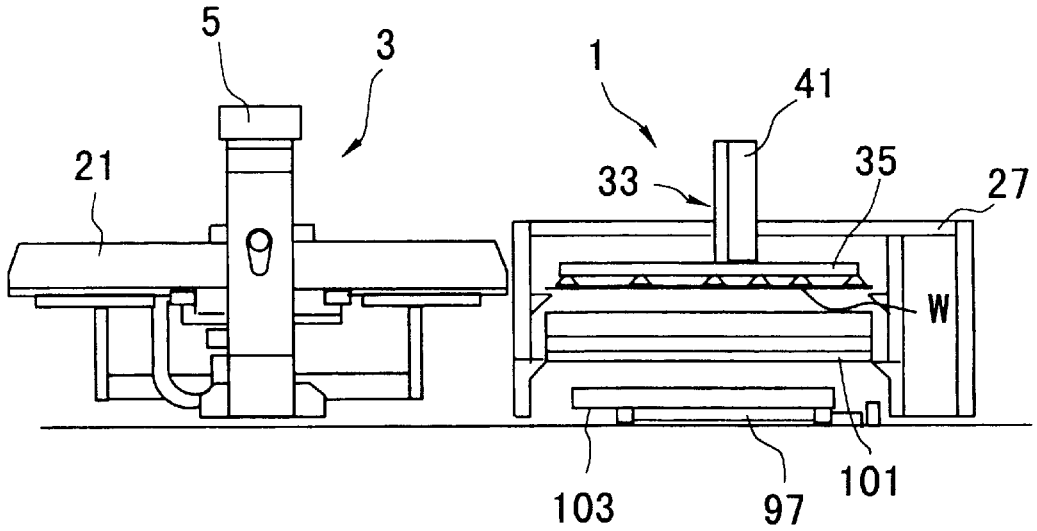
Figure 13:
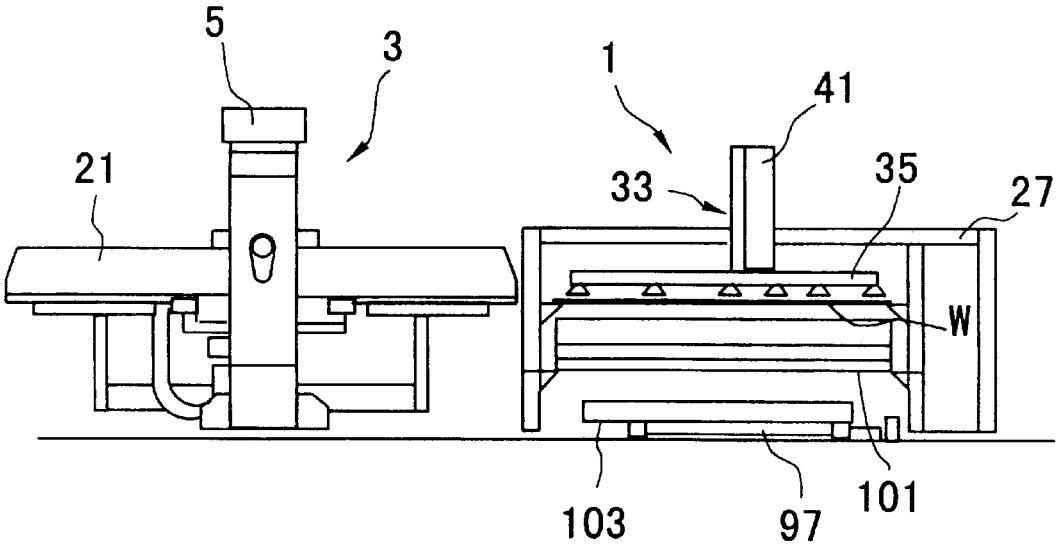
FIG. 13 is a front view for showing one process of the loading operation according to the loading and unloading device of the present invention.
Figure 14:
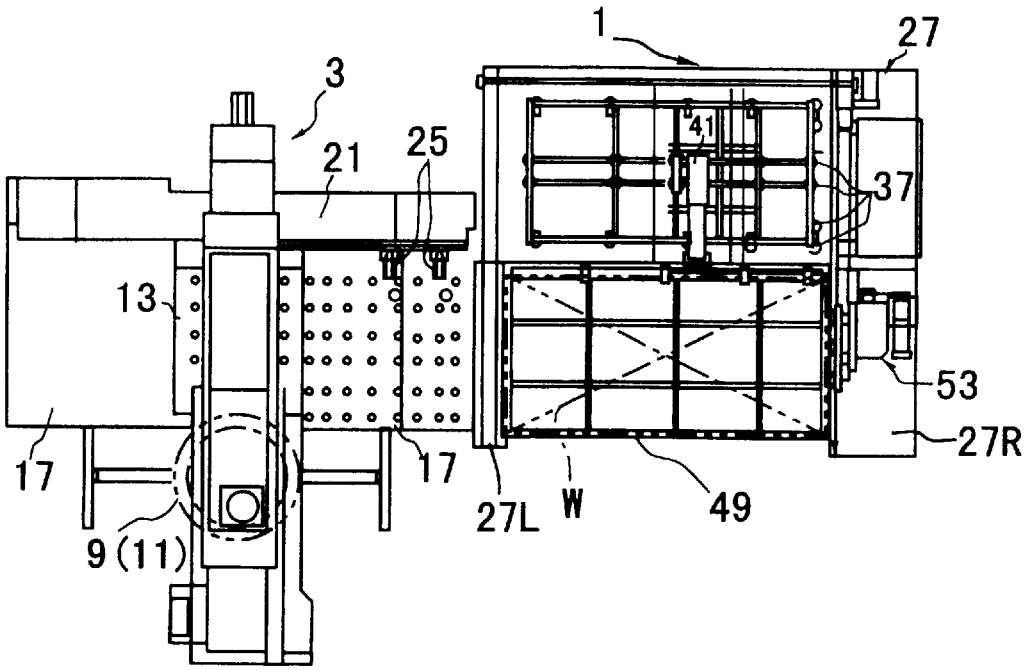
FIG. 14 is a plan view for showing one process of the loading operation according to the loading and unloading device of the present invention.

Then, the lifter 97 is dropped to return to the state shown in FIG. 9. The above-described process is repeated thereafter.

From the above result, it is understood that the one sheet taking-up unit 33 for a sheet metal W carries out only a vacuum chucking of the sheet metal W, and carrying unit is not necessary. Further, since the loader and unloader 53 as a carrier and unloader carries out only the carrying, the whole mechanism of the device can be simplified. Accordingly, a cost reduction can be achieved.

Further, since the position of the loader and unloader 53 is not same as the position of the one sheet taking-up unit 33 for the sheet metal W, the loading and the one sheet taking-up operation of the sheet metal W can be done at the same time. Therefore, the working time can be reduced. Further, at the time of working a sheet metal W larger than the working range of the turret punch press 3, the sheet metal W does not interrupt the one sheet taking-up unit 33 even if the sheet metal W is overhung. Therefore, it is not necessary to stop the working, so that the working efficiency can be improved. In this case, since the brush table 50 is waited, this can be used for repositioning.

Furthermore, since the working space 99 can be made vacant, the operator can work in a safe posture without unnatural position near the turret punch press 3.

The present invention is not limited to the above-described mode of implementation and can also be implemented in any other mode with a suitable modification. In other words, although the description has been made of the case where the turret punch press 3 is used as a sheet metal working machine in the above-described mode of implementation, the invention can also be applied to the case where a laser working machine is used, for example.

Furthermore, it is applicable that the one sheet taking-up unit 33 is hung with a plurality of magnetic chucks other than the plurality of vacuum pads 37 so-called vacuum chucks at the lattice point of a sheet taking-up frame 35 built in the lattice shape.

While preferred embodiments of the present invention have been described using specific terms, such description is for illustrative purposes, and it is to be understood that changes and variations may be made without departing from the spirit or scope of the following claims.

What is claimed is:

1. A loading and unloading device for sheet metals for loading and unloading sheet metals to and from a sheet metal working machine, comprising:

a chucking unit lifting vertically a sheet metal by chucking the sheet metal, the chucking unit being stationary in the horizontal direction;

a loading and unloading clamping unit disposed adjacent to the chucking unit, the loading and unloading clamping unit moving in a first horizontal direction of approaching to and leaving from the sheet metal working machine; and a sheet metal carrying unit carrying the sheet metal which is lifted by the chucking unit to the position of the loading and unloading clamping unit, the sheet metal carrying unit moving in a second horizontal direction which is perpendicular to the first horizontal direction;

wherein the sheet metal carrying unit comprises a supporting table which moves in the second horizontal direction between a position corresponding to the chucking unit and a position corresponding to the loading and unloading clamping unit.

2. The loading and unloading device for sheet metals according to claim 1 wherein the supporting table has a brush table which moves in the second direction; and the loading and unloading clamping unit has a lower jaw moving upwards and downwards.

3. The loading and unloading device for sheet metals according to claim 1, wherein the chucking unit does not move in either the first direction or the second direction.

4. The loading and unloading device for sheet metals according to claim 1, wherein a vacant working space is provided adjacent to the sheet metal carrying unit in the second direction.

5. The loading and unloading device for sheet metals according to claim 4, wherein the vacant working space is provided adjacent to the sheet metal working machine in the first direction.

* * * * *